US010654277B2

(12) United States Patent
Fujisawa et al.

(10) Patent No.: US 10,654,277 B2
(45) Date of Patent: May 19, 2020

(54) PRINTING APPARATUS

(71) Applicant: SEIKO EPSON CORPORATION, Tokyo (JP)

(72) Inventors: Kazutoshi Fujisawa, Okaya (JP); Hiroshi Asawa, Yamagata (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/096,903

(22) PCT Filed: Apr. 18, 2017

(86) PCT No.: PCT/JP2017/015631
§ 371 (c)(1),
(2) Date: Oct. 26, 2018

(87) PCT Pub. No.: WO2017/188071
PCT Pub. Date: Nov. 2, 2017

(65) Prior Publication Data

US 2019/0134985 A1 May 9, 2019

(30) Foreign Application Priority Data

Apr. 27, 2016 (JP) ..... 2016-089069

(51) Int. Cl.
*B41J 2/17* (2006.01)
*B41M 5/00* (2006.01)
(Continued)

(52) U.S. Cl.
CPC ..... *B41J 2/1721* (2013.01); *B41J 2/135* (2013.01); *B41J 2/1714* (2013.01); *B41J 2/185* (2013.01);
(Continued)

(58) Field of Classification Search
None
See application file for complete search history.

(56) References Cited

U.S. PATENT DOCUMENTS

2008/0074484 A1* 3/2008 Sugahara ..... B41J 2/16538 347/102
2009/0073232 A1 3/2009 Nakata et al.
(Continued)

FOREIGN PATENT DOCUMENTS

JP 2004-188919 A 7/2004
JP 2005-103852 4/2005
(Continued)

OTHER PUBLICATIONS

International Search Report dated May 23, 2017 for PCT/JP2017/015631.

*Primary Examiner* — Erica S Lin
(74) *Attorney, Agent, or Firm* — Workman Nydegger

(57) ABSTRACT

This printing apparatus is provided with a discharge head, a movement unit for moving a recording medium in a prescribed direction relative to the discharge head, a support member for supporting the recording medium in a position of facing the discharge head, a light-emitting unit for emitting light downstream in the prescribed direction from the discharge head, a first opposing unit disposed between the discharge head and the light-emitting unit in the prescribed direction, a second opposing unit disposed downstream of the discharge head in the prescribed direction, and an optically transparent member that is disposed between the first opposing unit and the second opposing unit and that covers the light-emitting unit from the support member. The optically transparent member is provided between the light-emitting unit and an opening defined between the support-member-side end of the first opposing unit and the support-member-side end of the second opposing unit, light emitted from the light-emitting unit is radiated from the opening onto the recording medium after transmitting through the optically transparent member, and the distance from the
(Continued)

opening to the optically transparent member is greater than or equal to 40% of the width of the opening in the prescribed direction.

4 Claims, 5 Drawing Sheets

(51) Int. Cl.
*B41J 11/00* (2006.01)
*B41J 2/135* (2006.01)
*B41J 2/185* (2006.01)
*B41M 7/00* (2006.01)

(52) U.S. Cl.
CPC ..... *B41J 11/002* (2013.01); *B41M 5/0011* (2013.01); *B41M 7/0081* (2013.01)

(56) References Cited

U.S. PATENT DOCUMENTS

2014/0292920 A1* 10/2014 Shibata ..... B41J 2/1714 347/34
2014/0292925 A1 10/2014 Wanibe

FOREIGN PATENT DOCUMENTS

JP 2009-034831 A 2/2009
JP 2012-020481 A 2/2012
JP 2014-188694 A 10/2014

* cited by examiner

| | EXAMPLE A | EXAMPLE B | EXAMPLE C | EXAMPLE D | EXAMPLE E | EXAMPLE F |
|---|---|---|---|---|---|---|
| OPENING WIDTH | 5 mm | 5 mm | 5 mm | 5 mm | 10 mm | 10 mm |
| GUIDE DEPTH | 0.8 mm | 1.4 mm | 2 mm | 3 mm | 3 mm | 4 mm |
| RATIO | 16% | 28% | 40% | 60% | 30% | 40% |
| INK ADHESION | YES | YES | MINUTE | NO | YES | MINUTE |

Fig. 3

PRINTING APPARATUS

TECHNICAL FIELD

This invention relates to technology for discharging, from a discharging head, a liquid that is cured by being irradiated with light, and for printing an image by irradiating the liquid with light from an irradiation unit.

BACKGROUND ART

PTL 1 describes an ink jet recording device that cures a photocurable ink discharged from a recording head by irradiating the ink with light from a light irradiation device. This light irradiation device includes a light-transmitting member that covers a light source from the recording medium, and light emitted from the light source is radiated onto the recording medium after transmitting through the light-transmitting member.

CITATION LIST

Patent Literature

PTL 1: JP-A-2004-188919

SUMMARY OF INVENTION

Technical Problem

According to this PTL 1, an advantage is afforded in that it is possible to prevent a misted liquid (ink) generated in a printing apparatus (ink jet recording device) from adhering to a light-emitting unit (light source). However, PTL 1 is not always effective to adhesion of the misted liquid to an optically transparent member (light-transmitting member), and there is a case that the misted liquid cured by being irradiated with light after adhering to the optically transparent member interrupts traveling of the light and the recording medium cannot be irradiated with enough amount of light. In particular, as in PTL 1, in a configuration in which the recording medium is moved relative to a discharging head (recording head), the misted liquid flown up by an air flow generated by this movement tends to adhere to the optically transparent member.

The invention has been made in view of the situation described above, and an advantage of the invention is to provide technology for making it possible to suppress adhesion of a misted liquid to an optically transparent member covering a light-emitting unit that emits light for curing the liquid.

Solution to Problem

The present invention is made to address at least some of the above-described issues, and can be realized as the following aspects.

A printing apparatus according to the invention includes a discharging head configured to discharge a liquid onto a recording medium, a movement unit configured to move the recording medium in a prescribed direction relative to the discharging head, a support member that is disposed at a position of facing the discharging head and is configured to support the recording medium, a light-emitting unit that is disposed downstream of the discharging head in the prescribed direction and is configured to emit light for curing the liquid, a first opposing unit disposed between the discharging head and the light-emitting unit in the prescribed direction, a second opposing unit disposed downstream of the discharging head in the prescribed direction, and an optically transparent member that is disposed between the first opposing unit and the second opposing unit in the prescribed direction and is configured to cover the light-emitting unit from the support member. The optically transparent member is provided between the light-emitting unit and an opening defined between a support-member-side end of the first opposing unit and a support-member-side end of the second opposing unit, light emitted from the light-emitting unit is radiated from the opening onto the recording medium after transmitting through the optically transparent member, and a distance from the opening to the optically transparent member is greater than or equal to 40% of a width of the opening in the prescribed direction.

In an irradiation unit of the thus-configured printing apparatus, the first opposing unit and the second opposing unit are provided on both sides of the light-emitting unit, and the optically transparent member is provided between the light-emitting unit and the opening defined between recording-medium-side ends of these opposing units. In addition, since the distance from the opening to the optically transparent member is set to greater than or equal to 40% of the width of the opening, it is possible to suppress the arrival of the misted liquid entered from the opening at the optically transparent member. Thus, it is possible to suppress adhesion of the misted liquid to the optically transparent member.

In addition, the printing apparatus may be configured such that the width of the first opposing unit in the prescribed direction is greater than or equal to the width of the opening in the prescribed direction. Such a configuration makes it possible to stabilize an air flow generated as the recording medium moves relative to the discharging head, and is advantageous in suppressing adhesion of the misted liquid to the optically transparent member.

In addition, the printing apparatus may be configured such that the width of the second opposing unit in the prescribed direction is greater than or equal to the width of the opening in the prescribed direction. Such a configuration makes it possible to stabilize an air flow generated as the recording medium moves relative to the discharging head, and is advantageous in suppressing adhesion of the misted liquid to the optically transparent member.

In addition, the printing apparatus may be configured to include a suction part configured to suck air between the discharging head and the first opposing unit. Such a configuration makes it possible to suck the misted liquid by means of the suction part, and is advantageous in suppressing adhesion of the misted liquid to the optically transparent member.

Note that all of the plurality of components included in each of the above-described aspects of the invention are not necessary, and in order to solve some or all of the above-described issues, or in order to achieve some or all of effects described in this specification, with respect to some components of the plurality of components, it is possible to perform, as appropriate, change, deletion, replacement with other new components, or deletion of some of limited contents. In addition, in order to solve some or all of the above-described issues, or in order to achieve some or all of effects described in this specification, it is possible to combine some or all of technical features included in one of the above-described aspects of the invention with some or all of technical features included in another one of the above-described aspects of the invention to arrive at an independent aspect of the invention.

BRIEF DESCRIPTION OF DRAWINGS

FIG. 3 is a diagram illustrating the relationship between the ratio of a guide part depth to an opening width and adhesion of an ink to an optically transparent flat plate.

DESCRIPTION OF EMBODIMENTS

Figure 1:
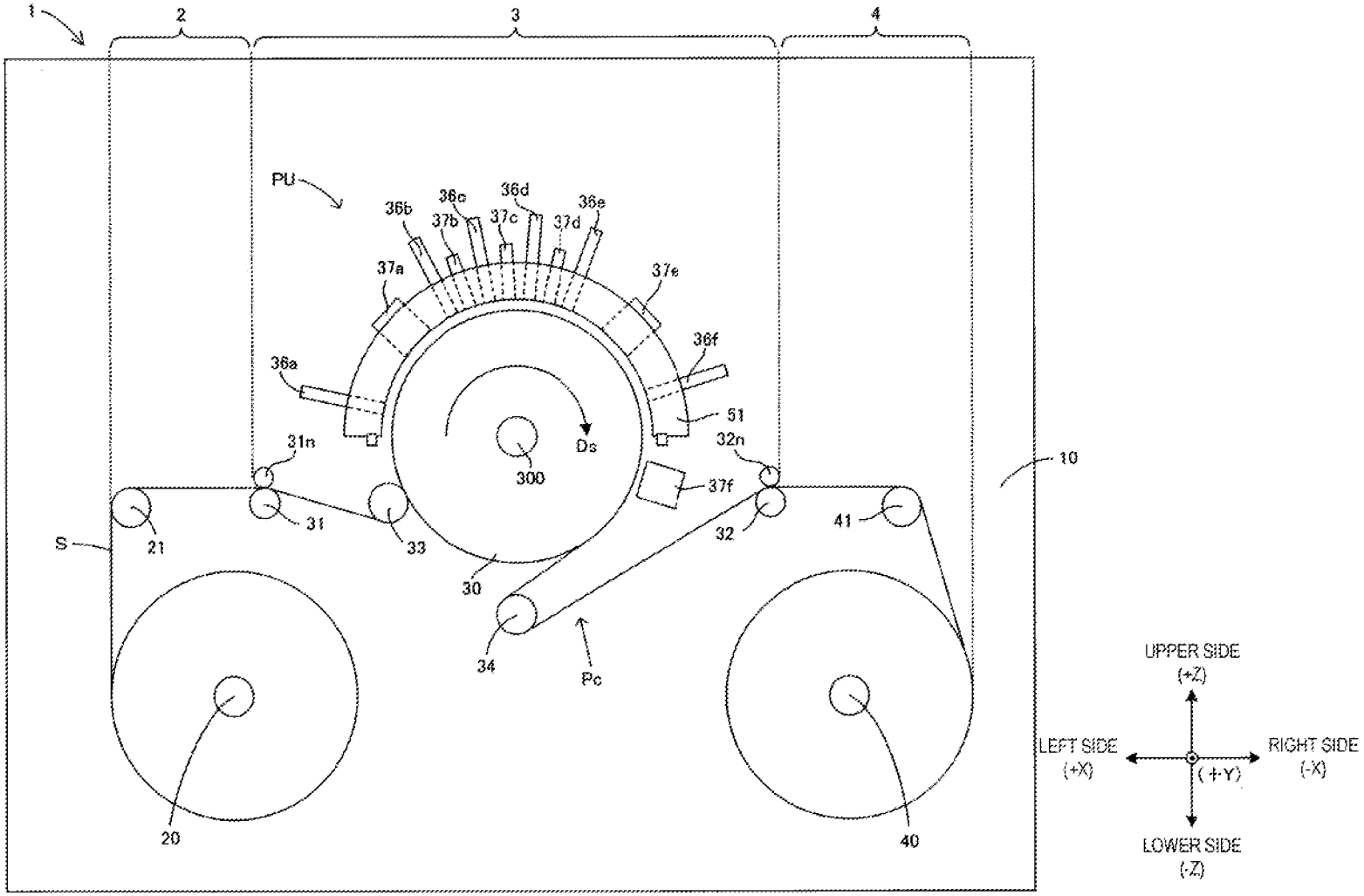
FIG. 1 is a diagram illustrating a printer to which the invention is applied.

FIG. 1 is a front view schematically illustrating an example of a printer to which the invention is applied. Note that in FIG. 1 and the following drawings, the XYZ orthogonal coordinate system corresponding to a left-right direction X, a front-rear direction Y, and a vertical direction Z of a printer 1 is provided as appropriate for clarity of arrangement relationships of apparatus components.

As illustrated in FIG. 1, in the printer 1, one sheet S (web) is stretched along a conveyance path Pc, both edges of the sheet S wound around a feeding shaft 20 and a winding shaft 40 in a roll shape, and the sheet S is subjected to image recording while being conveyed in a conveyance direction Ds directed from the feeding shaft 20 to the winding shaft 40. Types of the sheet S are broadly divided into a paper-based type and a film-based type. To give specific examples, the paper-based type includes woodfree paper, cast paper, art paper, coated paper, and the like, and the film-based type includes synthetic paper, PET (Polyethylene terephthalate), PP (polypropylene), and the like. Schematically, the printer 1 includes a feeding section 2 (feeding area) for feeding the sheet S from the feeding shaft 20, a process section 3 (process area) for recording an image on the sheet S fed from the feeding section 2, and a winding section 4 (winding area) for winding the sheet S on which the image has been recorded in the process section 3 around the winding shaft 40, and these function sections 2, 3, and 4 aligned in the X direction are accommodated in a housing 10. Note that in the following description, of both surfaces of the sheet S, the surface on which the image is recorded will be referred to as a front surface and the reverse side surface of the front surface will be referred to as a back surface.

The feeding section 2 includes the feeding shaft 20 around which an edge of the sheet S is wound, and a driven roller 21 on which the sheet S drawn out from the feeding shaft 20 is wound. The feeding shaft 20 supports the sheet S by winding the edge of the sheet S around the feeding shaft 20 with the front surface of the sheet S facing outward. In addition, when the feeding shaft 20 is rotated clockwise in FIG. 1, the sheet S wound around the feeding shaft 20 is fed to the process section 3 via the driven roller 21. In this regard, the sheet S is wound around the feeding shaft 20 via a core pipe (not illustrated) that is detachable from the feeding shaft 20. Thus, when the sheet S around the feeding shaft 20 is used up, it is possible to attach, to the feeding shaft 20, a new core pipe around which the rolled sheet S has been wound so as to replace the sheet S around the feeding shaft 20.

The winding section 4 winds, around the winding shaft 40, the sheet S on which the color image has been formed by the process section 3. Specifically, in addition to the winding shaft 40 around which the edge of the sheet S has been wound, the winding section 4 includes a driven roller 41 for winding the sheet S between the winding shaft 40 and a rear driving roller 32 of the process section 3 from the back surface side of the sheet S. The winding shaft 40 supports the sheet S by winding the edge of the sheet S around the winding shaft 40 with the front surface of the sheet S facing outward. That is, when the winding shaft 40 is rotated clockwise in FIG. 1, the sheet S conveyed from the rear driving roller 32 of the process section 3 is wound around the winding shaft 40 via the driven roller 41. In this regard, the sheet S is wound around the winding shaft 40 via a core pipe (not illustrated) that is detachable from the winding shaft 40. Thus, when the sheet S wound around the winding shaft 40 becomes full, it is possible to detach the sheet S together with the core pipe.

While supporting the sheet S fed from the feeding section 2 by means of the rotary drum 30, the process section 3 performs processing for printing an image on the sheet S, as appropriate, by means of a process unit PU disposed along an outer circumferential surface of the rotary drum 30. In this process section 3, a front driving roller 31 and a rear driving roller 32 are provided on both sides of the rotary drum 30, and the sheet S conveyed from the front driving roller 31 to the rear driving roller 32 is supported by the rotary drum 30 and is subjected to the image printing.

The front driving roller 31 has a plurality of minute protrusions formed on the outer circumferential surface of the front driving roller 31 by thermal spraying, and the sheet S fed from the feeding section 2 is wound on the front driving roller 31 from the back surface side of the sheet S. In addition, by being rotated clockwise in FIG. 1, the front driving roller 31 conveys the sheet S fed from the feeding section 2 downstream in the conveyance direction Ds. Note that a nip roller 31*n* is provided with respect to the front driving roller 31. This nip roller 31*n* makes contact with the front surface of the sheet S while being biased toward the front driving roller 31, and the sheet S is sandwiched between the nip roller 31*n* and the front driving roller 31. This makes it possible to secure a frictional force between the front driving roller 31 and the sheet S and reliably perform conveyance of the sheet S by means of the front driving roller 31.

The rotary drum 30 is a cylindrical drum having a central axis parallel to the Y direction, and the sheet S is wound on the outer circumferential surface of the rotary drum 30. In addition, the rotary drum 30 includes a rotary shaft 300 extending in an axis direction along the central axis of the cylindrical shape of the rotary drum 30. The rotary shaft 300 is rotatably supported by a support mechanism, which is not illustrated, and the rotary drum 30 is rotated about the rotary shaft 300.

On the outer circumferential surface of this rotary drum 30, the sheet S conveyed from the front driving roller 31 to the rear driving roller 32 is wound from the back surface side of the sheet S. In addition, the rotary drum 30 supports the sheet S from the back surface side of the sheet S while being driven to rotate in the conveyance direction Ds of the sheet S by receiving a frictional force between the rotary drum 30 and the sheet S. In this regard, the process section 3 is provided with driven rollers 33 and 34 that fold back the sheet S on both sides of the part at which the sheet S is wound on the rotary drum 30. Of these driven rollers, the front surface of the sheet S is wound on the driven roller 33 between the front driving roller 31 and the rotary drum 30 so as to fold back the sheet S. On the other hand, the front surface of the sheet S is wound on the driven roller 34 between the rotary drum 30 and the rear driving roller 32 so as to fold back the sheet S. In this way, by folding back the sheet S respectively upstream and downstream of the rotary drum 30 in the conveyance direction Ds, it is possible to secure a long length of the part at which the sheet S is wound on the rotary drum 30.

The rear driving roller 32 has a plurality of minute protrusions formed on the outer circumferential surface of the rear driving roller 32 by thermal spraying, and the sheet S conveyed from the rotary drum 30 via the driven roller 34 is wound on the rear driving roller 32 from the back surface side of the sheet S. In addition, by being rotated clockwise in FIG. 1, the rear driving roller 32 conveys the sheet S to the winding section 4. Note that a nip roller 32*n* is provided with respect to the rear driving roller 32. This nip roller 32*n* makes contact with the front surface of the sheet S while being biased toward a rear driving roller 32, and the sheet S is sandwiched between the nip roller 32*n* and the rear driving roller 32. This makes it possible to secure a frictional force between the rear driving roller 32 and the sheet S and reliably perform conveyance of the sheet S by means of the rear driving roller 32.

In this way, the sheet S conveyed from the front driving roller 31 to the rear driving roller 32 is supported by the outer circumferential surface of the rotary drum 30. In addition, in the process section 3, in order to print a color image on the front surface of the sheet S supported by the rotary drum 30, the process unit PU is provided. This process unit PU has a configuration in which discharging heads 36*a* to 36*f* and UV irradiators 37*a* to 37*e* are supported by a carriage 51.

Six discharging heads 36*a* to 36*f* aligned in the conveyance direction Ds in this order each correspond to white, yellow, cyan, magenta, black, or clear (transparent), and discharge a corresponding ink jet-type color ink from a nozzle. That is, in each of the discharging heads 36*a* to 36*f*, a plurality of nozzles are disposed across the width of the sheet S in the Y direction, and each of the nozzles discharges a drop-like ink, i.e., an ink drop.

These six discharging heads 36*a* to 36*f* are disposed radially from the rotary shaft 300 of the rotary drum 30, and aligned along the outer circumferential surface of the rotary drum 30. In addition, each of the discharging heads 36*a* to 36*f* is positioned by the carriage 51 with respect to the rotary drum 30, and faces the rotary drum 30 with a slight clearance (platen gap). This makes each of the discharging heads 36*a* to 36*f* face, with a prescribed paper gap, the front surface of the sheet S wound on the rotary drum 30. In a state in which the paper gap is defined in this way by the carriage 51, by each of the discharging heads 36*a* to 36*f* discharging an ink drop, the ink drop lands at a desired position on the front surface of the sheet S, and a color image is formed on the front surface of the sheet S.

In this regard, in a case that an image is printed on the transparent sheet S, the discharging head 36*a* that discharges a white ink is used to form a white background on the sheet S. Specifically, the discharging head 36*a* forms the background by discharging the white ink such that a whole area in which the image is to be formed is filled up. Then, the discharging heads 36*b* to 36*e* that discharge yellow, cyan, magenta, and black inks form a color image to superpose the white background. In addition, the discharging head 36*f* discharges a clear ink to superpose the color image so as to cover the color image with the clear ink. This gives the color image texture such as glossy feeling or mat feeling.

As an ink used in the discharging heads 36*a* to 36*f*, a UV (ultraviolet) ink (photocurable ink), which is cured by being irradiated with ultraviolet rays (light), is used. Thus, in order to cure and fix the ink to the sheet S, the process unit PU is provided with the UV irradiators 37*a* to 37*e*. Note that this ink curing is performed by separately using final curing and temporary curing. Here, final curing is processing for curing an ink to such a degree as to stop wet spreading of the ink by irradiating the ink with ultraviolet rays having a relatively strong irradiation intensity compared with temporary curing, and temporary curing is processing for curing an ink to such a degree that wet spreading of the ink becomes slow enough compared with a case that the ink is not irradiated with ultraviolet rays by irradiating the ink with ultraviolet rays having a relatively weak irradiation intensity.

Specifically, the UV irradiator 37*a* for final curing is disposed between the discharging head 36*a* for white and the discharging head 36*b* for yellow. Thus, the white background formed by the discharging head 36*a* is final cured by being irradiated with ultraviolet rays from the UV irradiator 37*a* before the inks from the discharging heads 36*b* to 36*e* are superposed on the white background. The UV irradiators 37*b* to 37*d* for temporary curing are respectively disposed between the discharging heads 36*b* to 36*e* for yellow, cyan, magenta, and black. Thus, the inks respectively discharged from the discharging heads 36*b* to 36*d* are temporary cured by being irradiated with ultraviolet rays from the UV irradiators 37*b* to 37*d* before being superposed by the inks from the discharging heads 36*c* to 36*e* downstream in the conveyance direction Ds. This suppresses the occurrence of color mixture such as mixture of inks respectively discharged from the discharging heads 36*b* to 36*e*. The UV irradiator 37*e* for final curing is disposed between the discharging head 36*e* for black and the discharging head 36*f* for clear. Thus, the color image formed by the discharging heads 36*b* to 36*e* is final cured by being irradiated with ultraviolet rays from the UV irradiator 37*e* before the ink from the discharging head 36*f* is superposed on the color image.

In addition, in the process section 3, the UV irradiator 37*f* for final curing is provided downstream of the discharging head 36*f* in the conveyance direction Ds. Thus, the clear ink discharged by the discharging head 36*f* to be superposed on the color image is completely cured by being irradiated with ultraviolet rays from the UV irradiator 37*f*. Note that the UV irradiator 37*f* is not provided in the carriage 51.

Figure 2:
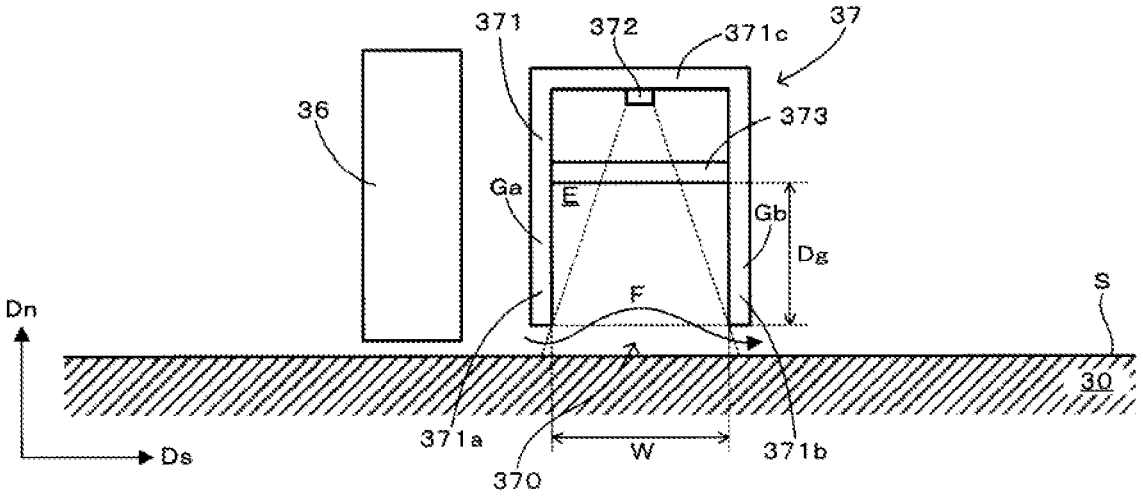
FIG. 2 is a diagram illustrating a first configuration example of a UV irradiator with a discharging head.

FIG. 2 is an illustration schematically illustrating a first configuration example of a UV irradiator with a discharging head. Note that in this figure, the front surface (circumferential surface) of the rotary drum is represented by approximation using straight lines. In addition, in this figure, a normal line direction Dn (orthogonal to the conveyance direction Ds) of the front surface of the rotary drum is illustrated, and this figure illustrates a front view from a direction orthogonal to the conveyance direction Ds and the normal line direction Dn (in other words, a width direction of the sheet S). Note that, hereinafter, the discharging heads 36*a* to 36*f* will be collectively referred to as discharging heads 36, as appropriate, without distinction from each other, and the UV irradiators 37*a* to 37*f* will be collectively referred to as UV irradiators 37, as appropriate, without distinction from each other.

As illustrated in this figure, the UV irradiator 37 includes a casing 371 having an opening 370 facing the rotary drum 30, and a light-emitting unit 372 accommodated inside the casing 371. The light-emitting unit 372 is a light emitting body such as UVLED, metal halide lamp, or mercury lamp, and, in the width direction (Y direction) of the sheet S, one or a plurality of light emitting bodies are disposed within a range wider than the width of the discharging head 36. The casing 371 includes an upstream partition wall part 371*a* that is positioned upstream of the light-emitting unit 372 in the conveyance direction Ds, and a downstream partition wall part 371*b* that is positioned downstream of the light-emitting unit 372 in the conveyance direction Ds, and each of the partition wall parts 371*a* and 371*b* faces the sheet S supported by the rotary drum 30 with a slight clearance. The upstream partition wall part 371*a* and the downstream partition wall part 371*b* are longer than the light-emitting unit 372 in the width direction (Y direction) of the sheet S. In this way, the opening 370 is defined between the rotary drum 30 side (hereinafter will be referred to as the sheet S side) end of the upstream partition wall part 371*a* and the sheet S side end of the downstream partition wall part 371*b*. In addition, the casing 371 includes a ceiling part 371*c* that couples the ends of these partition wall parts 371*a* and 371*b* on the opposite side to the sheet S, and the light-emitting unit 372 attached to the inner side (the surface on the side of facing the rotary drum 30) of the ceiling part 371*c* faces the opening 370 from the opposite side to the rotary drum 30 across the sheet S.

In addition, the UV irradiator 37 include an optically transparent flat plate 373 attached between the upstream partition wall part 371*a* and the downstream partition wall part 371*b* in the conveyance direction Ds. More specifically, the optically transparent flat plate 373 is vertically attached to respective inner walls of the upstream partition wall part 371*a* and the downstream partition wall part 371*b* provided in parallel to each other. This optically transparent flat plate 373 is positioned between the opening 370 and the light-emitting unit 372, and light emitted from the light-emitting unit 372 passes through the opening 370 after transmitting through the optically transparent flat plate 373, and the sheet S is irradiated with the light. The optically transparent flat plate 373 like this may be formed of various materials that make it possible for the optically transparent flat plate 373 to transmit the emitted light, for example, quartz glass, soda-lime glass, acrylic resin, polyvinyl chloride resin, or silicone resin.

In the UV irradiator 37 like this, respective parts of the upstream partition wall part 371*a* and the downstream partition wall part 371*b* on the sheet S side with respect to the optically transparent flat plate 373 function as guide parts Ga and Gb that guide the traveling of light. In addition, in this way, by shifting the optically transparent flat plate 373 from the opening 370 toward the light-emitting unit 372 and forming a space E surrounded by the guide parts Ga and Gb and the optically transparent flat plate 373, it is possible to suppress adhesion of a misted ink to the optically transparent flat plate 373. This will be described below in detail.

In response to conveyance of the sheet S in the conveyance direction Ds, an air flow toward the conveyance direction Ds is generated between the UV irradiator 37 and the sheet S. Thus, part of the air between the discharging head 36 and the UV irradiator 37, accompanied by a misted ink, tends to pass through between the guide part Ga and the sheet S and enter the space E. However, since an internal pressure of the space E increases due to the entrance of this air, an air flow pushing air out of the space E is generated, and as a result, an air flow exiting the space E and passing through between the guide part Gb and the sheet S is generated. Thus, an air flow F is generated between the UV irradiator 37 and the sheet S, the air flow F slightly entering into the space E and then exiting the space E while traveling from upstream to downstream of the UV irradiator 37 in the conveyance direction Ds. This suppresses the entrance of the misted ink into the space E, and consequently suppresses adhesion of the misted ink to the optically transparent flat plate 373.

In addition, in the UV irradiator 37, a depth Dg of the guide parts Ga and Gb, i.e., the depth Dg of the space E is set to greater than or equal to 40% of a width W of the opening 370. Here, the depth Dg of the guide parts Ga and Gb can be determined as, for example, a distance from sheet S side ends of the guide parts Ga and Gb to the optically transparent flat plate 373 in the normal line direction Dn passing through the center of the opening 370. Note that in a case that the lengths of the guide parts Ga and Gb are different from each other, the depth Dg can be determined as, for example, a distance from the sheet S side end closer to the optically transparent flat plate 373 among the respective sheet S side ends of the guide parts Ga and Gb to the optically transparent flat plate 373. In addition, the width W of the opening 370 can be determined as, for example, the width of the opening 370 in a direction orthogonal to the normal line direction Dn passing through the center of the opening 370 (this direction can be approximated to the conveyance direction Ds in FIG. 2). This makes it possible to more effectively suppress adhesion of the misted ink to the optically transparent flat plate 373, as illustrated in FIG. 3.

FIG. 3 is a diagram illustrating, as a table, the result of determining, through an experiment, the relationship between the ratio of a guide part depth to an opening width and adhesion of an ink to the optically transparent flat plate. That is, this figure illustrates the result of visually checking adhesion of a misted ink to the optically transparent flat plate 373 while changing the ratio of the guide part depth Dg to the opening width W (=W/Dg). Note that in the experiment in this figure, the relative speed of the sheet S with respect to the discharging head 36 and the UV irradiator 37 is 250 mm/s, and it is considered that this experimental result is established at least when this relative speed is 250 mm/s or less. As illustrated in examples C, D, and F, it is found that, when the ratio of the guide part depth Dg to the opening width W is greater than or equal to 40%, adhesion of the misted ink to the optically transparent flat plate 373 is effectively suppressed.

As described above, in the UV irradiator 37 of the printer 1 according to this embodiment, the upstream partition wall part 371*a* and the downstream partition wall part 371*b* are provided on both sides of the light-emitting unit 372, and the optically transparent flat plate 373 is provided between the light-emitting unit 372 and the opening 370 defined between the sheet S side ends of the partition wall parts 371*a* and 371*b*. In addition, since the distance (depth Dg) from the opening 370 to the optically transparent flat plate 373 is set to greater than or equal to 40% of the width W of the opening, it is possible to effectively suppress the arrival of the misted ink entered from the opening 370 at the optically transparent flat plate 373. Thus, it is possible to effectively suppress adhesion of the misted ink to the optically transparent flat plate 373.

Figure 4:
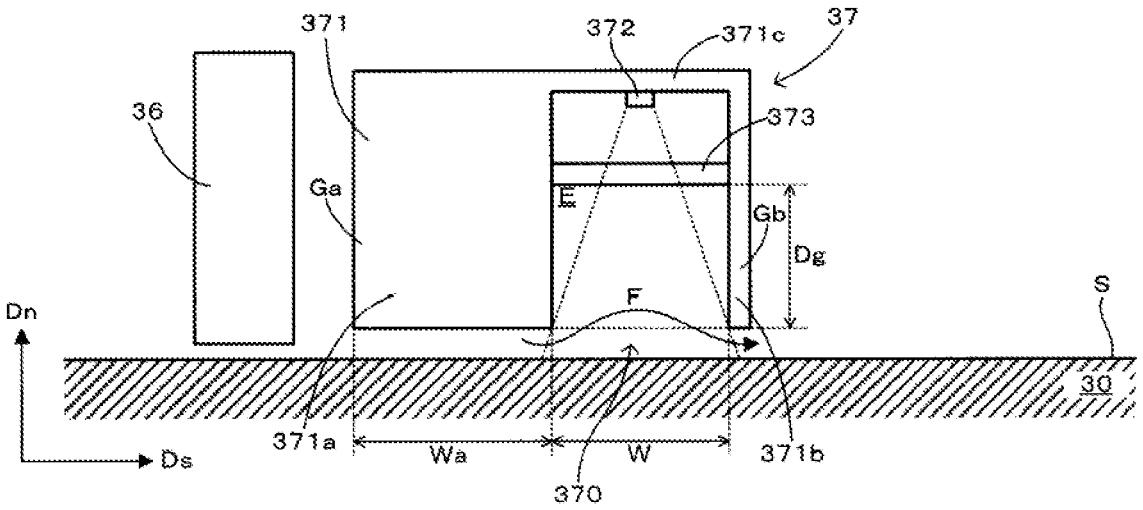
FIG. 4 is a diagram illustrating a second configuration example of the UV irradiator with the discharging head.

FIG. 4 is a diagram schematically illustrating a second configuration example of a UV irradiator with a discharging head. The representation in FIG. 4 is similar to that in FIG. 2. The differences from the above-described embodiment will be described mainly below, and common points are denoted by corresponding reference signs to omit description of the common points as appropriate. However, as a matter of course, similar effects are achieved by incorporating the configurations in common with the above-described embodiment.

In the UV irradiator 37 according to the second configuration example, a width Wa of the upstream partition wall part 371*a*, i.e., the width Wa of a flat surface, facing the sheet S, of the upstream partition wall part 371*a* is greater than or equal to the width W of the opening 370. Here, the width Wa of the upstream partition wall part 371*a* is determined, for example, based on the direction orthogonal to the normal line direction Dn passing through the center of the opening 370, similarly to the above-described method of determining the width W of the opening 370. In such a configuration, it is possible to secure a long length of a range in which the upstream partition wall part 371*a* and the sheet S face each other in the conveyance direction Ds, and to stabilize an air flow passing through between the upstream partition wall part 371*a* and the sheet S in the conveyance direction Ds. As a result, it is possible to more effectively suppress adhesion of the misted ink to the optically transparent flat plate 373.

Figure 5:
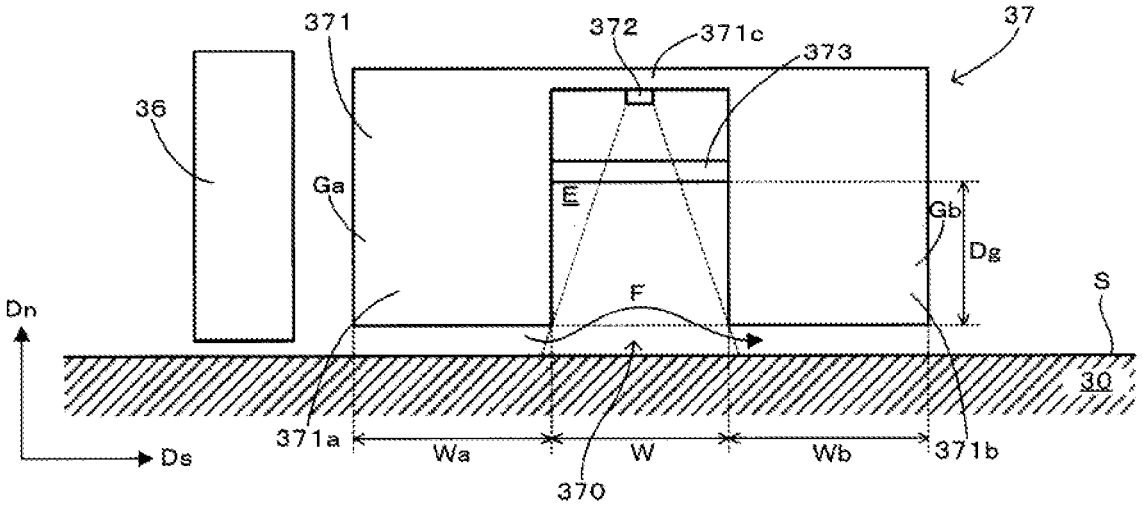
FIG. 5 is a diagram illustrating a third configuration example of the UV irradiator with the discharging head.

FIG. 5 is a diagram schematically illustrating a third configuration example of a UV irradiator with a discharging head. The representation in FIG. 5 is similar to that in FIG. 4. The differences from the above-described embodiment will be described mainly below, and common points are denoted by corresponding reference signs to omit description of the common points as appropriate. However, as a matter of course, similar effects are achieved by incorporating the configurations in common with the above-described embodiment.

In the UV irradiator 37 according to the third configuration example, in addition to the width Wa of the upstream partition wall part 371*a*, a width Wb of the downstream partition wall part 371*b*, i.e., the width Wb of a flat surface, facing the sheet S, of the downstream partition wall part 371*b* is greater than or equal to the width W of the opening 370. Here, the width Wb of the downstream partition wall part 371*b* is determined, for example, based on the direction orthogonal to the normal line direction Dn passing through the center of the opening 370, similarly to the above-described method of determining the width W of the opening 370. In such a configuration, it is possible to secure a long length of a range in which the downstream partition wall part 371*b* and the sheet S face each other in the conveyance direction Ds, and to stabilize an air flow passing through between the downstream partition wall part 371*b* and the sheet S in the conveyance direction Ds. As a result, it is possible to more effectively suppress adhesion of the misted ink to the optically transparent flat plate 373.

As described above, in the above-described embodiment, the printer 1 corresponds to an example of the "printing apparatus" of the invention, the discharging heads 36 and 36*a* to 36*f* correspond to an example of the "discharging head" of the invention, the rotary drum 30 corresponds to an example of the "support member" of the invention, the ink corresponds to an example of the "liquid" of the invention, the sheet S corresponds to an example of the "recording medium" of the invention, the feeding shaft 20, the front driving roller 31, the rear driving roller 32, and the winding shaft 40 cooperatively function as an example of the "movement unit" of the invention, the conveyance direction Ds corresponds to an example of the "prescribed direction" of the invention, the UV irradiators 37 and 37*a* to 37*f* correspond to an example of the "irradiation unit" of the invention, the light-emitting unit 372 corresponds to an example of the "light-emitting unit" of the invention, the upstream partition wall part 371*a* corresponds to an example of the "first opposing unit" of the invention, the downstream partition wall part 371*b* corresponds to an example of the "second opposing unit" of the invention, the optically transparent flat plate 373 corresponds to an example of the "optically transparent member" of the invention, and the opening 370 corresponds to an example of the "opening" of the invention.

Note that the present invention is not limited to the above-described exemplary embodiments, and various modifications can be made to the above-described exemplary embodiments without departing from the spirit and gist of the present invention. Thus, the printer 1 may be configured as follows. Note that the differences from the above-described embodiment will be described mainly below, and common points are denoted by corresponding reference signs to omit description of the common points as appropriate. However, as a matter of course, similar effects are achieved by incorporating the configurations in common with the above-described embodiment.

Figure 6:
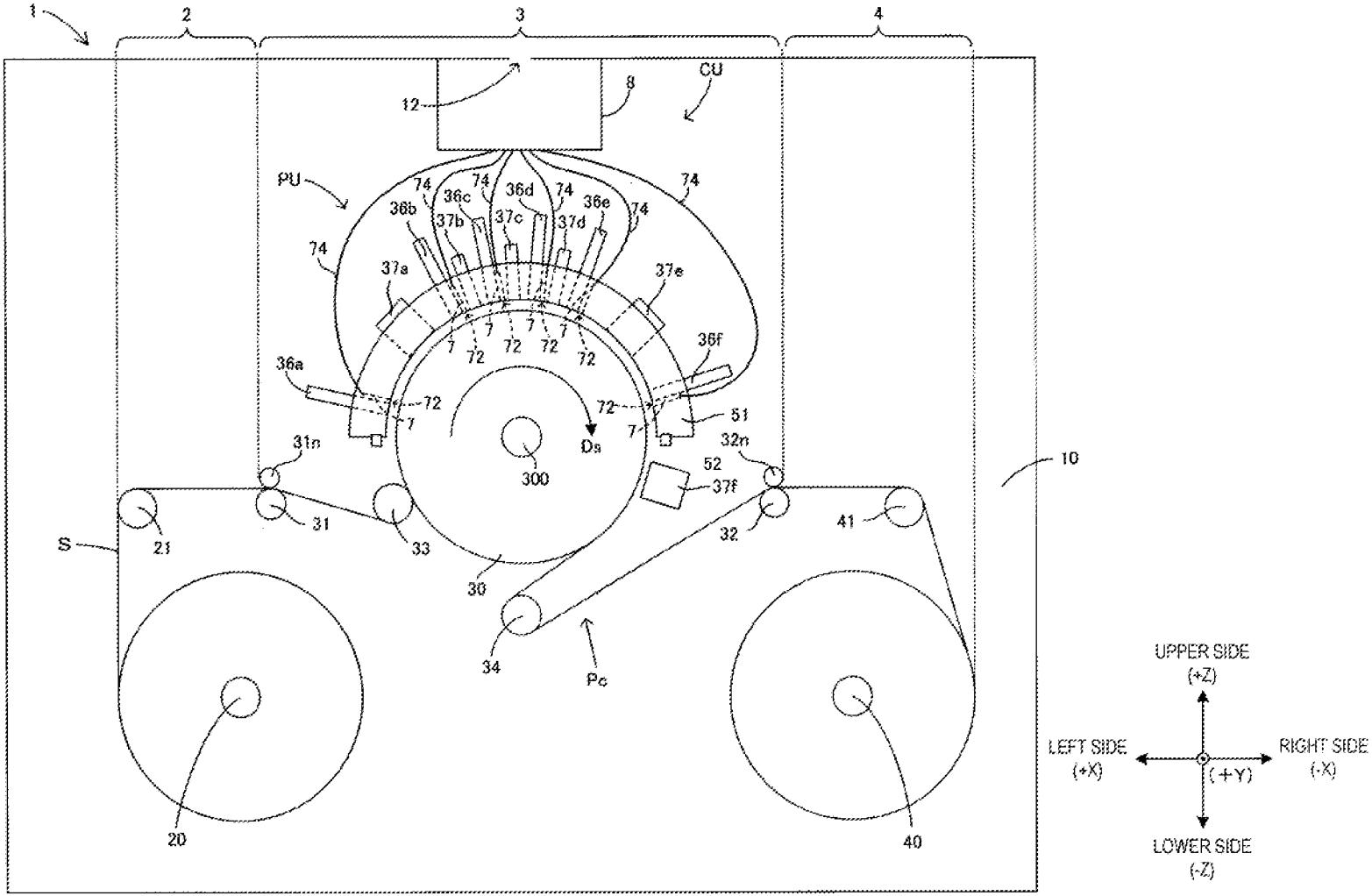
FIG. 6 is a diagram illustrating another example of the printer to which the invention is applied.

FIG. 6 is a front view schematically illustrating another example of a printer to which the invention is applied. In the printer 1 in FIG. 6, in order to suppress contamination of the discharging heads 36*a* to 36*f*, the UV irradiators 37*a* to 37*f*, and the like with a misted ink, the process section 3 includes a mist collection unit CU that collects the misted ink. This mist collection unit CU includes mist suction parts 7 disposed downstream of respective discharging heads 36*a* to 36*f* in the conveyance direction Ds. In this way, the mist suction parts 7 are provided between the discharging heads 36 and the UV irradiators 37 adjacent to each other. Note that the UV irradiators 37 include one of the first to third configuration examples described above. Each of the mist suction parts 7 is provided in the carriage 51 and includes a suction port 72 that opens to the rotary drum 30. This suction port 72 is extended in parallel to the Y direction, and is longer, in the Y direction, than a range in which a plurality of nozzles are disposed in the discharging heads 36*a* to 36*f*.

In addition, the mist collection unit CU includes a gas-liquid separation part 8, and flexible suction hoses 74 that connect respective mist suction parts 7 to the gas-liquid separation part 8. When the gas-liquid separation part 8 generates a negative pressure, an air flow directed from the suction ports 72 of the mist suction parts 7 toward the gas-liquid separation part 8 via the suction hoses 74 and exiting an exhaust port 12 provided in the housing 10 is generated. Thus, the misted ink floating between the discharging heads 36 and the UV irradiators 37 are sucked, together with air, from the suction ports 72 into the gas-liquid separation part 8.

As described above, in the printer 1 illustrated in FIG. 6, the mist suction parts 7 (suction part) that suck air between the discharging heads 36 and the casings 371 of the UV irradiators 37 are provided. Thus, it is possible to suck the misted ink by means of the mist suction parts 7, and to more effectively suppress adhesion of the misted ink to the optically transparent flat plates 373 of the UV irradiators 37.

In addition, the upstream partition wall part 371*a* and the downstream partition wall part 371*b* are provided as members forming the casing 371 of the UV irradiator 37. However, the upstream partition wall part 371*a* and the downstream partition wall part 371*b* may be formed of a different member from the casing 371 of the UV irradiator 37.

In addition, it is not necessary for all of the UV irradiators 37 to have one of the first to third configuration examples described above. That is, in a case that a UV irradiator 37 in which adhesion of the misted ink to the optically transparent flat plate 373 is not prominent is known, it is not necessary for the UV irradiator 37 to have a configuration as described in the first to third configuration examples.

In addition, although not particularly mentioned above, the casing 371 may be open or closed to a direction orthogonal to the conveyance direction Ds.

In addition, in the above-described embodiment, the sheet S is supported by the rotary drum 30 having a cylindrical shape. However, the shape of the member supporting the sheet S is not limited to this shape, and the sheet S may be supported by, for example, the front surface of a flat plate.

In addition, in the above-described embodiment, the printer 1 that conveys the sheet S is described. However, it is possible to apply a configuration as described in the first to third configuration examples above, and the like to the printer 1 that includes the discharging heads 36 and the UV irradiators 37 in a carriage and moves the discharging heads 36 and the UV irradiators 37 together with the carriage while fixing the sheet S.

REFERENCE SIGNS LIST

1 . . . Printer, 20 . . . Feeding shaft, 30 . . . Rotary drum, 31 . . . Front driving roller, 32 . . . Rear driving roller, 40 . . . Winding shaft, 36, 36*a* to 36*f* . . . Discharging head, 37, 37*a* to 37*f* . . . UV irradiator, 370 . . . Opening, 371 . . . Casing, 371*a* . . . Upstream partition wall part, 371*b* . . . Downstream partition wall part, 371*c* . . . Ceiling part, 372 . . . Light-emitting unit, 373 . . . Optically transparent flat plate, Ga . . . Guide part, Gb . . . Guide part, Dg . . . Guide part depth, W . . . Opening width, E . . . Space, F . . . Air flow, S . . . Sheet, Ds . . . Conveyance direction, Dn . . . Normal line direction The entire disclosure of Japanese Patent Application No. 2016-089069, filed Apr. 27, 2016 is expressly incorporated by reference herein.

The invention claimed is:

1. A printing apparatus comprising:

a discharging head configured to discharge a liquid onto a recording medium;

a movement unit configured to move the recording medium in a prescribed direction relative to the discharging head;

a drum shaped support member that is disposed at a position of facing the discharging head and is configured to support the recording medium;

a light-emitting unit that is disposed downstream in the prescribed direction from the discharging head and is configured to emit light for curing the liquid;

a first opposing unit disposed between the discharging head and the light-emitting unit in the prescribed direction;

a second opposing unit disposed downstream of the discharging head in the prescribed direction; and an optically transparent member that is disposed between the first opposing unit and the second opposing unit in the prescribed direction and is configured to cover the light-emitting unit from the support member, wherein the optically transparent member is provided between the light-emitting unit and an opening defined between a support-member-side end of the first opposing unit and a support-member-side end of the second opposing unit, light emitted from the light-emitting unit is radiated from the opening onto the recording medium after transmitting through the optically transparent member, and a distance from the opening to the optically transparent member is greater than or equal to 40% of a width of the opening in the prescribed direction.

2. The printing apparatus according to claim 1, wherein a width of the first opposing unit in the prescribed direction is greater than or equal to the width of the opening in the prescribed direction.

3. The printing apparatus according to claim 1, wherein a width of the second opposing unit in the prescribed direction is greater than or equal to the width of the opening in the prescribed direction.

4. The printing apparatus according to claim 1, further comprising a suction part configured to suck air between the discharging head and the first opposing unit.

* * * * *